US009935391B2

(12) United States Patent
Wang

(10) Patent No.: US 9,935,391 B2
(45) Date of Patent: Apr. 3, 2018

(54) WIRE ADAPTER ASSEMBLY

(71) Applicant: Shenzhen Sinotek Technology Co., Ltd., Shenzhen, Guangdong Province (CN)

(72) Inventor: Fengliang Wang, Shenzhen (CN)

(73) Assignee: Shenzhen Sinotek Technology Co., Ltd., Shenzhen (CN)

( * ) Notice: Subject to any disclaimer, the term of this patent is extended or adjusted under 35 U.S.C. 154(b) by 0 days.

(21) Appl. No.: 15/325,686

(22) PCT Filed: Dec. 22, 2015

(86) PCT No.: PCT/CN2015/098238

§ 371 (c)(1),
(2) Date: Jan. 11, 2017

(87) PCT Pub. No.: WO2016/124046

PCT Pub. Date: Aug. 11, 2016

(65) Prior Publication Data

US 2017/0331217 A1 Nov. 16, 2017

(51) Int. Cl.

| | |
|---|---|
| ***H01R 13/514*** | (2006.01) |
| ***H01R 31/06*** | (2006.01) |
| ***H01R 27/00*** | (2006.01) |

(52) U.S. Cl.

CPC ..... *H01R 13/514* (2013.01); *H01R 27/00* (2013.01); *H01R 31/06* (2013.01)

(58) Field of Classification Search

CPC ..... H01R 31/06; H01R 27/00; H01R 13/514; H01R 33/92; H01R 33/90

See application file for complete search history.

(56) References Cited

U.S. PATENT DOCUMENTS

| | | | | |
|---|---|---|---|---|
| 7,393,247 | B1 * | 7/2008 | Yu | G06F 13/409 439/638 |
| 7,556,535 | B2 * | 7/2009 | Liao | H01R 13/6273 439/640 |
| 8,512,053 | B2 * | 8/2013 | Worth | H01R 13/60 439/119 |

(Continued)

FOREIGN PATENT DOCUMENTS

| | | |
|---|---|---|
| CN | 202268586 U | 6/2012 |
| CN | 203339446 U | 12/2013 |
| CN | 204615112 U | 9/2015 |

*Primary Examiner* — Briggitte R Hammond
(74) *Attorney, Agent, or Firm* — Maschoff Brennan

(57) ABSTRACT

A wire adapter assembly, comprising: a plug, comprising a first housing and a first male connector installed on a first end of the first housing, a second end of the first housing being equipped with a wire in electrical connection with the first male connector; an adapter, comprising a second housing and a first female connector installed at a first end of the second housing, the first female connector being adaptive to the first male connector, a second end of the second housing being equipped with a second male connector in electrical connection with the first female connector, and the first male connector being different from the second male connector; and a flexible connector, the flexible connector being of a flat strip or arc hinge structure, and connected with the first end of the first housing and the first end of the second housing respectively.

8 Claims, 4 Drawing Sheets

(56) References Cited

U.S. PATENT DOCUMENTS

| | | | | |
|---|---|---|---|---|
| 2006/0073717 | A1* | 4/2006 | Ng | H01R 35/04<br>439/131 |
| 2008/0032554 | A1* | 2/2008 | Kuo | H01R 31/06<br>439/607.41 |

* cited by examiner

WIRE ADAPTER ASSEMBLY

CROSS-REFERENCE TO RELATED APPLICATIONS

This application is the national phase of International Application No. PCT/CN2015/098238, filed Dec. 22, 2015, which claims the benefit of Chinese Patent Application No. 201510063710.3, filed with the Chinese State Intellectual Property Office on Feb. 6, 2015, the entire disclosures of the applications are incorporated herein by reference.

FIELD OF THE INVENTION

The present invention relates an electronic device plug. Particularly to wire/cable adapter assembly (or a dedicated plug set) is used for both charging and data synchronous communication connection.

DESCRIPTION OF THE RELATED ART

Electronic devices in the information age, especially portable electronic devices such as mobile phones. MP3s and Tablets, they all should be frequently connected with computers and chargers through wire/cable to complete such tasks as charging, data communication and synchronization. However, portable electronic devices normally have various connection interfaces. For example, iPhones and Android phones have their own unique interfaces (lighting and micro USB). Therefore, consumers normally need to carry two or even more cables. Plus, these cables are not portable and easy to get lost or forgotten, resulting in use inconvenience. The problems are generally solved by using the structure of wiring multiple cables with different interface plugs and then connect to a single USB port in the prior art. Although this structure solves the easily lost or forgotten problem, it is still inconvenient to carry and store because of multiple parallel arrangement cables are easily intertwined and take a large space.

DISCLOSURE OF THE INVENTION

The technical problem to be solved by the invention is to provide a wire adapter assembly for the defects in the prior art, so that electronic devices are capable of using the same wire/cable but with two or more connectors to adapt to different electronic device interfaces.

In order to realize the purpose, the invention provides a wire adapter assembly, comprising:

a plug, comprising a first housing and a first male connector installed on a first end of the first housing, a second end of the first housing being equipped with a wire in electrical connection with the first male connector;

an adapter, comprising a second housing and a first female connector installed at a first end of the second housing, the first female connector being adaptive to the first male connector, a second end of the second housing being equipped with a second male connector in electrical connection with the first female connector, and the first male connector being different from the second male connector; and a flexible connector, the flexible connector being of a flat strip or arc hinge structure, and connected with the first end of the first housing and the first end of the second housing respectively, the plug and the adapter both being respectively provided with a standby position, a first working position and a second working position, in the standby position, the plug and the adapter being installed in sequence, in the first working position, the first male connector being inserted into the first female connector, and in the second working position, the adapter being turned to one side of the plug.

In the wire adapter assembly, the flexible connector, the first housing and the second housing are of an integrated structure.

In the wire adapter assembly, the flexible connector is connected with the first housing and the second housing by bonding or injection molding.

In the wire adapter assembly, the flexible connector is a silicone connector consisting of a first connecting end, a body portion and a second connecting end integrated in sequence, and a first connecting part and a second connecting part corresponding to the first connecting end and the second connecting end respectively are installed on the first housing and the second housing.

In the wire adapter assembly, the first connecting end and the second connecting end are a connecting plane respectively, the first connecting part and the second connecting part are a groove installed on one broad side at the first end of the first housing and the first end of the second housing respectively, and the connecting plane is installed in the groove.

In the wire adapter assembly, the first connecting end and the second connecting end are a connecting tube respectively, the first connecting part and the second connecting part are an annular groove installed on the external surfaces of the first housing and the second housing respectively, and the connecting tube is sheathed in the annular groove.

In the wire adapter assembly, the first housing and/or the second housing is clad with a metal housing.

The wire adapter assembly further comprises:

at least an additional adapter, comprising an additional housing, an additional female connector and an additional male connector installed at both ends of the additional housing, the additional female connector being adapted to the second male connector or the additional male connector; and at least an additional flexible connector, the additional flexible connector being of a flat strip or arc hinge structure and used for connecting the adapter with the additional adapter, or connecting the additional adapters.

In order to better realize the purpose, the invention also provides a wire adapter assembly, comprising:

a plug, comprising a first housing and a first male connector installed on a first end of the first housing, a second end of the first housing being equipped with a wire in connection with the first male connector;

an adapter, comprising a second housing and a first female connector installed at a first end of the second housing, the first female connector being adaptive to the first male connector, a second end of the second housing being equipped with a second male connector in connection with the first female connector, and the first male connector being different from the second male connector; and a connector, the connector being of a flat strip structure, one end of the connector being fixedly connected with one broad side at the first end of the first housing or the first end of the second housing, the other end of the connector being hinged with the first end of the second housing or the first end of the first housing, the first housing or the second housing being provided with a sliding groove corresponding to the hinged end and used for inserting or unplugging the connector, the plug and the adapter being respectively provided with a standby position, a first working position and a second working position, in the standby position, the plug and the adapter being installed in sequence, in the first working position, the first male connector being inserted into the first female connector, and in the second working position, the adapter being turned to one side of the plug through the hinged end.

In the wire adapter assembly, the first housing, the second housing and the connector are all metal parts.

The utility model will be described in detail in combination with accompanied drawings and preferred embodiments, but the utility model is not restricted thereto.

1—plug
11—first housing
12—first male connector
13—first end of the first housing
14—second end of the first housing
15—first connecting part
2—adapter
21—second housing
22—first female connector
23—second male connector
24—first end of the second housing
25—second end of the second housing
26—second connecting part
3—flexible connector
31—first connecting end
32—body portion
33—second connecting end
4—wire/cable
5—metal housing

BEST MODE FOR CARRYING OUT THE PRESENT INVENTION

Figure 1:
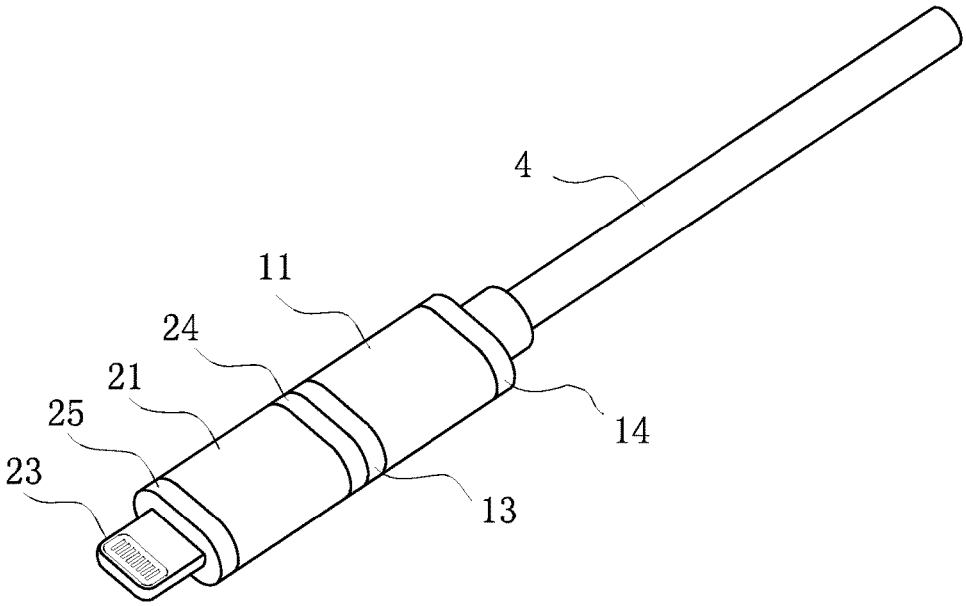
FIG. 1 is a structural diagram of an example of the invention (first working position)
Figure 2:
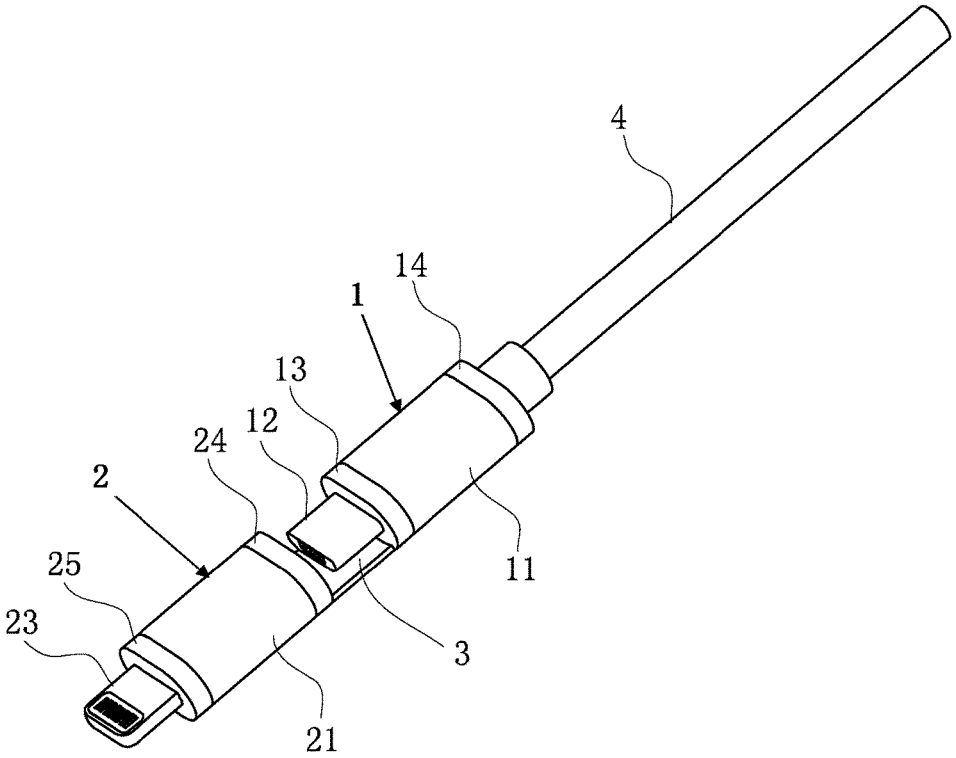
FIG. 2 is a schematic diagram of another state of FIG. 1 (standby position)
Figure 3:
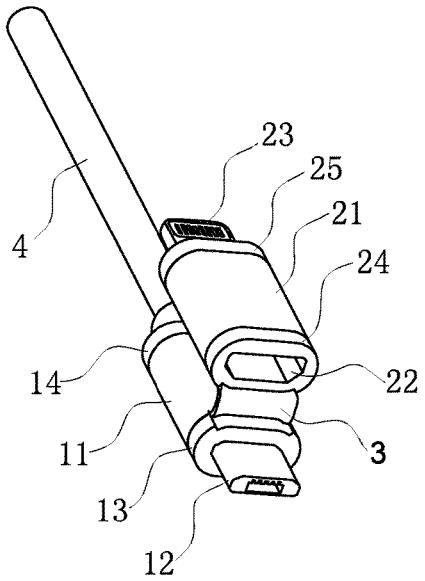
FIG. 3 is a schematic diagram of another state of FIG. 1 (second working position)

The structural principle and working principle of the invention will be described in detail in combination with the accompanied drawings:

Refer to FIGS. 1 to 3, FIG. 1 is a structural diagram of an example of the invention (first working position); FIG. 2 is a schematic diagram of another state of FIG. 1 (standby position); and FIG. 3 is a schematic diagram of another state of FIG. 1 (second working position). The cable/wire 4 adapter assembly of the invention comprises:

a plug 1, comprising a first housing 11 and a first male connector 12 installed on a first end 13 of the first housing, a second end 14 of the first housing being equipped with an electrical wire/cable 4 in connection with the first male connector 12;

an adapter 2, comprising a second housing 21 and a first female connector 22 installed at a first end 24 of the second housing, the first female connector 22 being adaptive to the first male connector 12, a second end 25 of the second housing being equipped with a second male connector 23 in electrical connection with the first female connector 22, and the first male connector 12 being different from the second male connector 23; and a flexible connector 3, the flexible connector being of a flat strip or arc hinge structure, and connected with the first end 13 of the first housing and the first end 24 of the second housing respectively, the plug 1 and the adapter 2 being connected by the flexible connector 3 and respectively provided with a standby position, a first working position and a second working position, in the standby position, the flexible connector 3 being in a stretched state, the plug 1 and the adapter 2 being installed in sequence, the adapter 2 being connected with the plug 1 by the flexible connector 3 (refer to FIG. 2); in the first working position, the first male connector 12 being inserted into the first female connector 22 (refer to FIG. 1), then the second male connector 23 of the plug 1 working and being connected with corresponding electronic device interfaces for charging or information transfer and synchronous operation; in the second working position, the adapter 2 being turned to one side of the plug 1 (refer to FIG. 3), then the flexible connector 3 serving as a connecting hinge, the first male connector 12 of the adapter 2 working and being connected with corresponding electronic device interfaces for charging or information transfer and synchronous operation. The first male connector 12 is for example an Android device connector, and the second male connector 23 is for example an Apple device connector.

The flexible connector 3 and the first housing 11 as well as the second housing 21 are preferably of an integrated structure. The flexible connector 3 can be connected with the first housing 11 and the second housing 21 by adhesion or injection molding. The flexible connector 3 is firmly bonded with the adapter and the plug 1 by adhesive, direct injection molding or other bonding methods. In the present invention, the flexible connector 3 is made of a well-selected silicone material, including the first connecting end 31, a body portion 32 and a second connecting end 33 integrated in sequence, a first connecting part 15 and a second connecting part 26 corresponding to the first connecting end 31 and the second connecting end 33 respectively are installed on the first housing 11 and the second housing 21.

Figure 4:
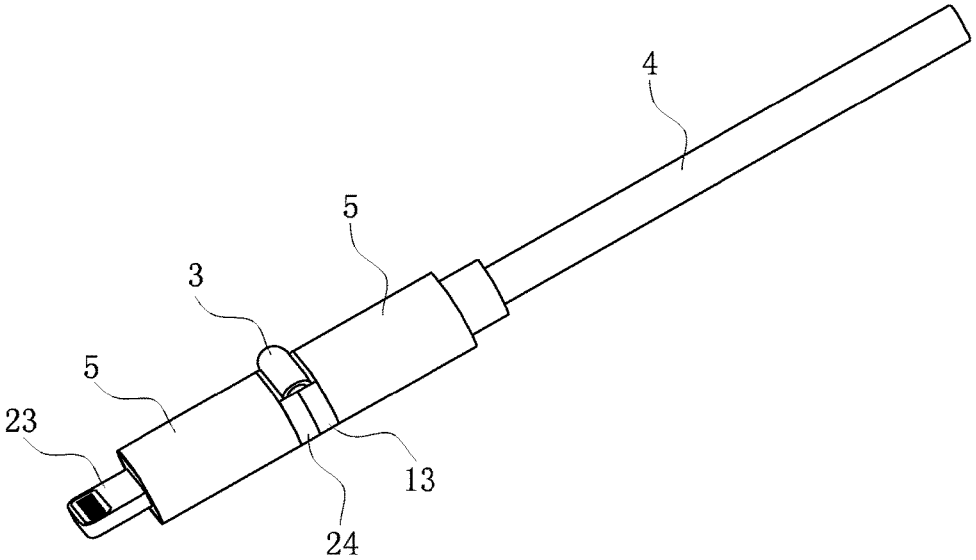
FIG. 4 is a structural diagram of another example of the invention (first working position)
Figure 5:
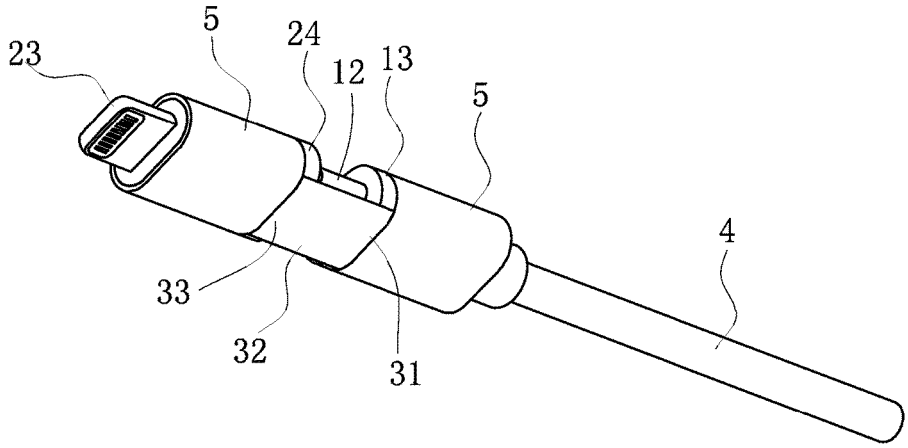
FIG. 5 is a structural diagram of another example of the invention (standby position)

Refer to FIG. 4 and FIG. 5, FIG. 4 is a structural diagram of another example of the invention (first working position), and FIG. 5 is a structural diagram of another example of the invention (standby position). The first connecting end 31 and the second connecting end 33 are a connecting plane respectively. The body portion 32 in FIG. 4 is a cambered surface of which the elasticity can be further enhanced, the body portion 32 in FIG. 5 is a plane, the first connecting part 15 and the second connecting part 26 are a groove installed on one broad side at the first end 13 of the first housing 11 and the first end 24 of the second housing 21 respectively, and the connecting plane is installed in the groove.

Figure 6:
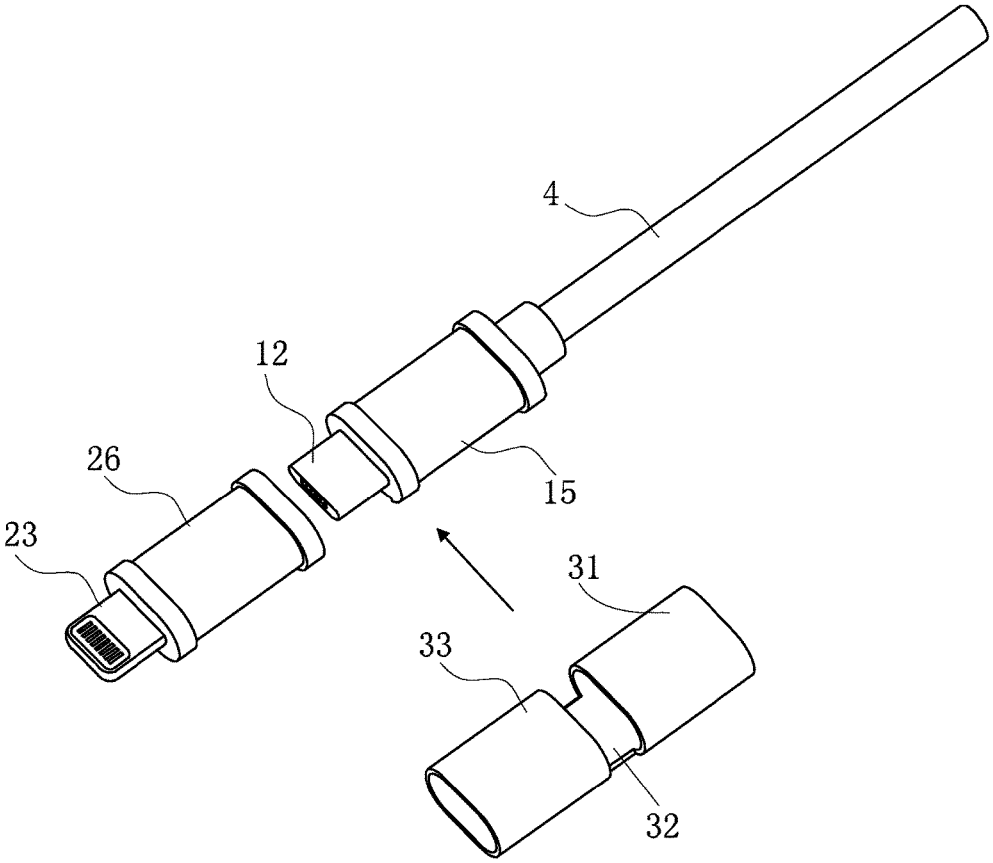
FIG. 6 is a breakdown structural diagram of another example of the invention.

Refer to FIG. 6, FIG. 6 is a breakdown structural diagram of another example of the invention. In the example, the first connecting end 31 and the second connecting end 33 are a connecting tube respectively, the first connecting part 15 and the second connecting part 26 are an annular groove installed on the external surfaces of the first housing 11 and the second housing 21 respectively, and the connecting tube is sheathed and hooped in the annular groove to connect the adapter and the plug 1 together.

Refer to FIG. 5, the first housing 11 and/or the second housing 21 can be clad with a metal housing 5 to firmly hold the adapter and the housing of the plug 1 as well as the connecting parts at both ends of the flexible connector 3, and the flexible connector 3 only exposes the middle strip body portion 32 to allow the structure to be more firm and the appearance to be more artistic.

In other examples of the invention, a third or more adapter can be further cascaded, comprising:

at least an additional adapter, comprising an additional housing, an additional female connector and an additional male connector installed at both ends of the additional housing and in electrical connection, and the additional female connector being adaptive to the second male connector 23 or the additional male connector;

at least an additional flexible connector, the additional flexible connector being of a flat strip or arc hinge structure for connecting the adapter 2 with the additional adapter, or connecting the additional adapters.

In the wire adapter assembly of the invention, the connector can be also a rigid connector, comprising:

a plug 1, comprising a first housing 11 and a first male connector 12 installed on a first end 13 of the first housing, a second end 14 of the first housing being equipped with a wire 4 in connection with the first male connector 12;

an adapter 2, comprising a second housing 21 and a first female connector 22 installed at a first end 24 of the second housing, the first female connector 22 being adaptive to the first male connector 12, a second end 25 of the second housing being equipped with a second male connector 23 in connection with the first female connector 22, and the first male connector 12 being different from the second male connector 23; and a rigid connector, the rigid connector being of a flat strip structure, one end of the connector being fixedly connected with one broad side at the first end 13 of the first housing or the first end 24 of the second housing, the other end of the connector being hinged with the first end 24 of the second housing or the first end 13 of the first housing, the first housing 11 or the second housing 21 being provided with a sliding groove corresponding to the hinged end and used for inserting or unplugging the connector, the plug 1 and the adapter 2 being respectively provided with a standby position, a first working position and a second working position, in the standby position, the plug 1 and the adapter 2 being connected in sequence by the rigid connector, in the first working position, the first male connector 12 being inserted into the first female connector 22, and in the second working position, the adapter 2 being turned to one side of the plug 1 through the hinged end. In the example, the first housing 11, the second housing 21 and the rigid connector are metal parts.

Of course, the invention may have other embodiments. Those skilled in the art can make various corresponding changes and modifications base on the invention without departing from the spirit and essence of the invention, but such changes and modifications should be incorporated in the protection scope of the appended claims of the invention.

INDUSTRIAL APPLICABILITY

The invention allows a wire to be suitable for connecting multiple electronic devices simultaneously to realize such functions as charging and data communication. In addition, the cable/wire is portable and not easy to get lost and intertwined.

The invention claimed is:

1. A wire adapter assembly, characterized by comprising:

a plug, comprising a first housing and a first male connector installed on a first end of the first housing, a second end of the first housing being equipped with a wire in electrical connection with the first male connector;

an adapter, comprising a second housing and a first female connector installed at a first end of the second housing, the first female connector being adaptive to the first male connector, a second end of the second housing being equipped with a second male connector in electrical connection with the first female connector, and the first male connector being different from the second male connector; and a flexible connector, the flexible connector being of a flat strip or arc hinge structure, and connected with the first end of the first housing and the first end of the second housing respectively, the plug and the adapter being respectively provided with a standby position, a first working position and a second working position, in the standby position, the plug and the adapter being installed in sequence, in the first working position, the first male connector being inserted into the first female connector, and in the second working position, the adapter being turned to one side of the plug; wherein:

the flexible connector is a silicone connector comprising a first connecting end, a body portion and a second connecting end integrated in sequence, and a first connecting part and a second connecting part corresponding to the first connecting end and the second connecting end respectively are installed on the first housing and the second housing;

the first connecting end and the second connecting end are a connecting plane or a connecting tube;

when the first connecting end and the second connecting end are a connecting plane, the first connecting part and the second connecting part are a groove installed on one broad side at the first end of the first housing and the first end of the second housing respectively, and the connecting plane is installed in the groove;

when the first connecting end and the second connecting end are a connecting tube, the first connecting part and the second connecting part are an annular groove installed on the external surfaces of the first housing and the second housing respectively, and the connecting tube is sheathed in the annular groove.

2. The wire adapter assembly according to claim 1, characterized in that the flexible connector, the first housing and the second housing are of an integrated structure.

3. The wire adapter assembly according to claim 2, characterized in that the flexible connector is connected with the first housing and the second housing by bonding or injection molding.

4. The wire adapter assembly according to claim 1 characterized in that the first housing and/or the second housing is clad with a metal housing.

5. A wire adapter assembly, characterized by comprising:

a plug, comprising a first housing and a first male connector installed on a first end of the first housing, a second end of the first housing being equipped with a wire in connection with the first male connector;

an adapter, comprising a second housing and a first female connector installed at a first end of the second housing, the first female connector being adaptive to the first male connector, a second end of the second housing being equipped with a second male connector in connection with the first female connector, and the first male connector being different from the second male connector; and a rigid connector, the rigid connector being of a flat strip structure, one end of the rigid connector being fixedly connected with the first end of the first housing or the first end of the second housing, the other end of the rigid connector being hinged with the first end of the second housing or the first end of the first housing, the first housing or the second housing being provided with a sliding groove corresponding to the hinged end and used for inserting or unplugging the rigid connector, the plug and the adapter being respectively provided with a standby position, a first working position and a second working position, in the standby position, the plug and the adapter being installed in sequence, in the first working position, the first male connector being inserted into the first female connector, and in the second working position, the adapter being turned to one side of the plug through the hinged end.

6. The wire adapter assembly according to claim 5, characterized in that the first housing, the second housing and the connector are metal parts.

7. The wire adapter assembly according to claim 2, characterized in that the first housing and/or the second housing is clad with a metal housing.

8. The wire adapter assembly according to claim 3, characterized in that the first housing and/or the second housing is clad with a metal housing.

* * * * *